US006782104B1

(12) United States Patent
Vieilledent

(10) Patent No.: US 6,782,104 B1
(45) Date of Patent: Aug. 24, 2004

(54) METHOD AND DEVICE INTENDED FOR THE PICKING UP OF SOUNDS, FOR THEIR RECORDING AND THEIR PLAY-BACK, AND REPRODUCING THE NATURAL SENSATION OF A SOUND SPACE

(75) Inventor: Georges Claude Vieilledent, Hedouville (FR)

(73) Assignee: ARKAMYS, Hedouville (FR)

( * ) Notice: Subject to any disclaimer, the term of this patent is extended or adjusted under 35 U.S.C. 154(b) by 0 days.

(21) Appl. No.: 09/473,893

(22) Filed: Dec. 28, 1999

(30) Foreign Application Priority Data

Dec. 31, 1998 (FR) ..... 98 16738

(51) Int. Cl.[7] ..... H04R 5/00
(52) U.S. Cl. ..... 381/26; 381/122; 381/61
(58) Field of Search ..... 381/26, 91, 122, 381/170, 362, 356, 357, 61, 63

(56) References Cited

U.S. PATENT DOCUMENTS

| | | | | | |
|---|---|---|---|---|---|
| 4,658,932 | A | * | 4/1987 | Billingsley | 181/175 |
| 4,742,548 | A | * | 5/1988 | Sessler et al. | 381/92 |
| 4,819,270 | A | * | 4/1989 | Lombardo | 381/26 |
| 5,073,936 | A | * | 12/1991 | Gorike et al. | 381/26 |
| 5,793,873 | A | * | 8/1998 | Magyari et al. | 381/26 |
| 6,005,950 | A | * | 12/1999 | Cuniberti | 381/61 |

FOREIGN PATENT DOCUMENTS

| | | | |
|---|---|---|---|
| DE | 1239355 | B | 8/1963 |
| EP | 186996 | A | 7/1986 |
| EP | 374902 | A | 6/1990 |
| FR | 2290811 | A | 6/1976 |
| FR | 2742624 | | 6/1997 |

* cited by examiner

*Primary Examiner*—Forester W. Isen
*Assistant Examiner*—Brian Pendleton
(74) *Attorney, Agent, or Firm*—Notaro & Michalos P.C.

(57) ABSTRACT

Method intended for the picking up of sounds coming from at least one sound source, for the recording of said sounds and their play-back, by means of a sound pick-up assembly, a recording medium and a transmission assembly.

the sound pick-up assembly being composed of at least two microphones, the relative position of which is constant, the recording medium being of any known stereophonic type, particularly with at least two tracks, the transmission assembly comprising at least two members such as earphones, loudspeakers or speaker boxes.

It is characterised in that sounds are picked up simultaneously by the two microphones, known as "right" (11) and "left" (12) respectively and that these two microphones (11 and 12) are displaced together with respect to said sound source (A), particularly by causing the distance and/or height of each microphone (11-12) to vary differentially with respect to that source (A), i.e. that one of them (11-12) is brought closer to the sound source (A) when the other (12-11) is moved away and vice versa, equally well by either of the two faces of the virtual plane that extends from one to the other, it being possible therefore for the right microphone (11) to become the left microphone (12) and vice versa, it being possible also for the two microphones (11 and 12) to be moved simultaneously closer to and further away from said sound source (A).

17 Claims, 4 Drawing Sheets

FIG.1
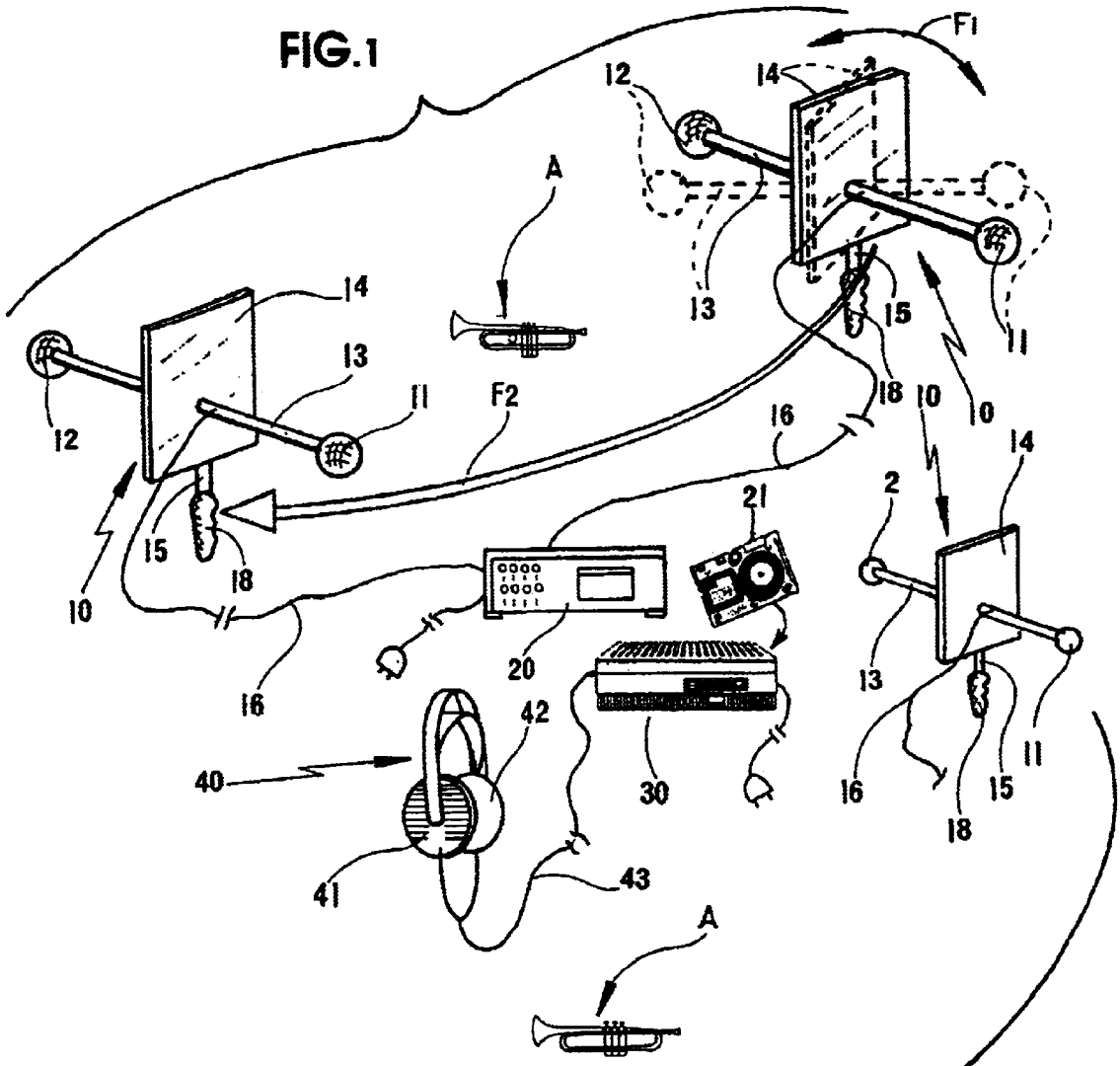
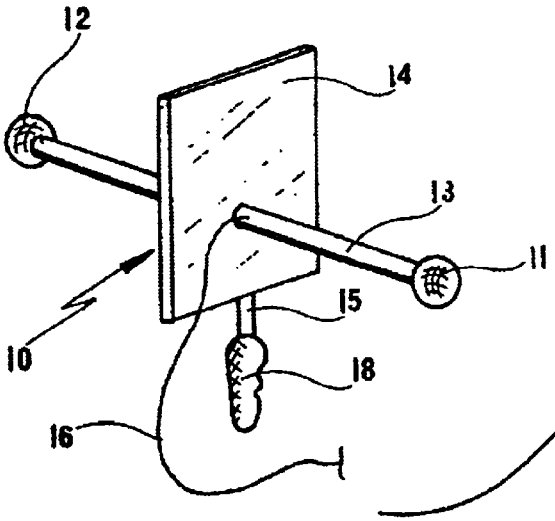
FIG.2

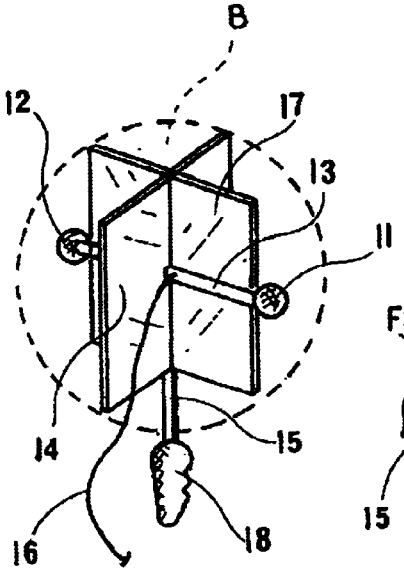
FIG.3
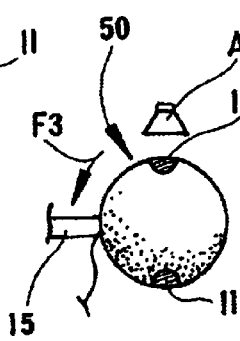
FIG.4
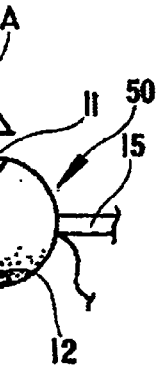
FIG.5
FIG.6
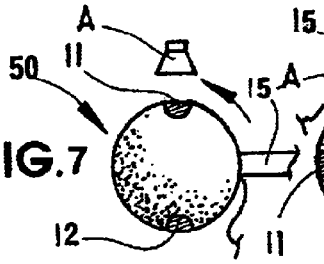
FIG.7
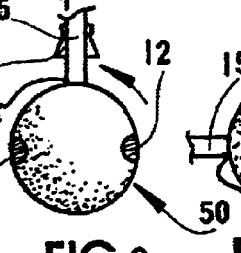
FIG.8
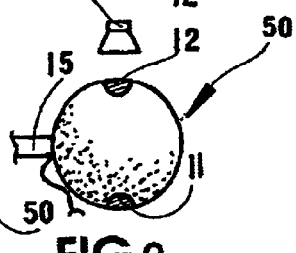
FIG.9
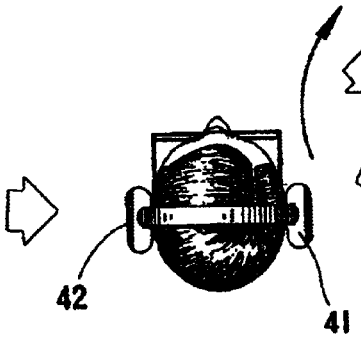
FIG.10
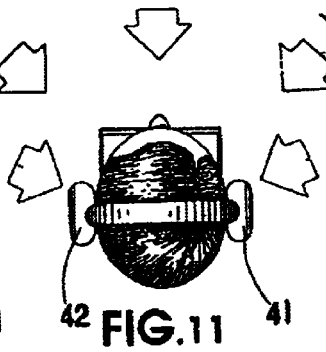
FIG.11
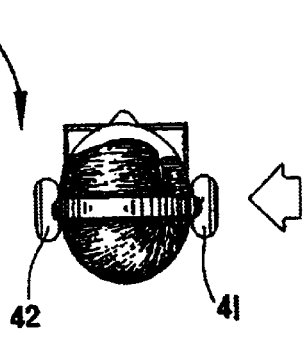
FIG.12
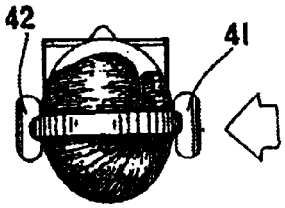
FIG.13
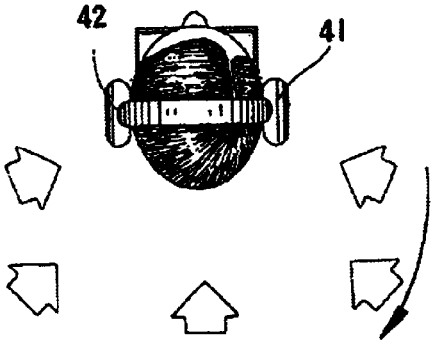
FIG.14
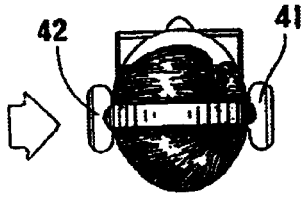
FIG.15

METHOD AND DEVICE INTENDED FOR THE PICKING UP OF SOUNDS, FOR THEIR RECORDING AND THEIR PLAY-BACK, AND REPRODUCING THE NATURAL SENSATION OF A SOUND SPACE

The stereophonic recording and playback of sounds has been known for some time.

Sound is picked up by at least two microphones fixed in a precise position and orientation and considered to be "strategic" with respect to the sound source.

The sounds coming from one of these two microphones, or from a set of microphones, are recorded on one track while the sounds coming from the second microphone, or from the second set of microphones, are recorded on another track, distinct from the first one.

Recorded sounds are played back by at least two speaker boxes (or loudspeakers) suitably positioned and oriented.

The binary nature of any stereophonic system comes from the transposition to sound of stereoscopy, dating back earlier, and itself based on the binocular vision of man.

While the optical systems that make use of this binocular vision, holograms, bipolar images or anaglyphs, for example, reproduce visual relief fairly well (at the expense of using many artifices, however), the same is not true of stereophonic systems, because of their very simplicity based on the fact that, naturally, man hears all the sounds in space from two sources alone.

In other words, all complex sounds distributed through a three-dimensional space, including different levels, are reduced to a single plane, joining together the speaker boxes and at their level alone.

This simplification is generally accepted because the human brain reconstitutes a true space virtually, particularly through the balance that is deliberately constructed between different sound sources, so that the listener has, or rather believes he has, an impression of relief.

It is not necessary to go into detail on the statement that relief implies three dimensions and not two, and it is easy to understand that, however far one goes in improving ad-hoc sound reproduction, stereophony has its own limitations simply because it limits the number of sound sources offered to the listener's hearing to two, themselves subject to the limitation on recording tracks, with no possibility of a third dimension.

To give context to the State of the Art, the following documents may be cited:

Article by Mr A Laracine published in the journal "ZERO VU", pages 40, 42, 44, 46, 47 and 48, which states that . . . "stereophony is only one stage" and that "the listener does not always find in it the opportunity for intelligent listening, but nevertheless the main ones and a large part of his liberty, and therefore his listening comfort", The author also points out that, in the case of orchestral music, . . . "if the general balance of the work has been obtained by the sound recordist, thanks to good positioning of the microphone, any other major action taken (level, corrections, difference in presence) will be experienced as a sort of "pleonasm" of sound and will distract the listener's attention". And, further on: "One solution consists in using cardioid microphones positioned 17 cm apart, their axes forming an angle of 110° between them. All calculations, all measurements and the very numerous experiments all combine to prove that this system is the best possible compromise. It is known by the system name AB O.R.T.F. since it was developed in the acoustic laboratory of the former O.R.T.F."

Naturally, all known recording systems concern positioned microphones, fixed once and for all throughout the recording. This is demonstrated by this extract from the same article:" . . . in the case of the picking up of sounds that are close together, a "tearing apart" of space is observed. This tearing apart is the same as that experienced by a spectator (sic) if he approaches the sound sources in the same way". Since the number of sound sources is always equal to two and since they occupy a fixed position from which they cannot be removed, the angle at which the listener perceives the sounds coming from these two sources varies depending on the space he occupies in relation to them and . . . "the difficulty arises from the fact that it is not possible to ask a listener to move closer to his speaker boxes temporarily. It is therefore necessary to find ways of creating faults with the O.R.T.F. pair to compensate for its unsuitability for certain situations. It is possible . . . to cause the pair to pivot on its axis in order to cause it to occupy an intermediate position between the horizontal plane and the vertical plane".

The existence of an occupied position clearly demonstrates, here too, that the pair is positioned and fixed.

In the Internet publication, at the address http:\\www.stereolith.ch, entitled "Stereolith® systme", the following is stated: "During a stereophonic recording, the sound space is encoded by a two-channel (dipole) matrix. For this, a pair of microphones is used, for example. Each of the microphones provides a signal that is slightly different depending on the location of the sound source. This slight difference is of great importance. The spaciousness of the recording is depends solely on this difference." And further on: "In modem electronic music the vital sound space is produced in the studio, by means of special three-dimensional (sic) processors."

This same publication contains the following information regarding listening by means of speaker boxes: "Outside the ideal listening point, it is impossible for our brain to reconstitute the sound image: the elementary information is missing or distorted. This means that, very often, we obtain merely bi-channel reproduction rather than stereophonic reproduction".

The document published by Schoeps GmbH, Spitalstr. 20, 7500 Karlsruhe 41 (Germany) describes a pair of microphones associated with a sphere based on the human head, which constitutes an assembly that has to be fixed to a "strategic" location: "The new approach should take account of all the parameters characterising the sound source and its location". This therefore definitely relates to an immobile sound source, situated in a given location relative to the pair of microphones, which is itself immobile. The technical specification of this apparatus requires, furthermore, that the sound pick-up angle is fixed at around 90° and that there is:

an accessory supplied with the device itself, which is an "accessory for suspending the microphone with a ball joint. Total weight: around 0.5 kg".

"a ball joint for mounting on a stand".

Spheres carrying two microphones do exist in different variants, one of which is described in the patent document EP 0 050 100, all providing improvements to the structure of the sphere, in order to bring it as close as possible to a genuine human head, in the hope of making the recording conditions coincide with the listening conditions but, as has been indicated above, the limitation of stereophony is in its binary nature and, therefore, in the static situation of the microphones and speaker boxes, located respectively upstream and downstream of the recording tracks.

Patent document FR 2 290 811, which describes a piece of apparatus for picking up sounds intended to eliminate sounds considered to be interference in comparison with those that are intended to be picked up, this device comprising just one or two microphones, depending on whether the apparatus is intended for a single person or for two. One example of using this apparatus is for the direct transmission, without recording, of words spoken by one or two people located in a moving vehicle, by means of powerful loudspeakers. Another example of the use of this apparatus is to integrate it into a loudspeaker-type telephone.

The result sought is the purity of the transmitted sounds, obtained by eliminating echo, ambient noise and open-air sounds.

Patent document DE 1 239 355, which describes a piece of apparatus comprising a stand and two microphones that can be oriented with respect to a support fixed to the stand. This apparatus is therefore fixed and its microphones are capable of movement with respect to the place where the apparatus is placed.

Patent document EP 0 186 996, which describes a microphone with a particular structure allowing it to be very directional when it is placed in a precise position with respect to the sound source. The microphone is therefore fixed and, like the device in the document FR 2 290 811, tends to avoid ambient noise and echo arising from the acoustic characteristics of the location where the sound is picked up.

It should be noted that this document does not cover recording or transmission of sound, since it is limited to the structure of a microphone and the description of FIG. 4 seems to signify that the invention is applied to what is known as a "hands-free" car-phone.

The present invention relates to a method that is different from the known ones, based on very realistic sound transmission, i.e. close to reality, which presupposes in particular high "relief" and the presence of ambient sounds, corresponding to real conditions. In this way the invention makes it possible to reconstitute, on listening, a three-dimensional sound space, including the vertical levels and the spaces in front of and behind the listener.

To this end, the subject-matter of the invention is a method intended for the picking up of sounds coming from at least one sound source, for the recording of said sounds and their play-back, by means of a sound pick-up assembly, a recording medium and a transmission assembly.

the sound pick-up assembly being composed of at least two microphones, the relative position of which is constant, the recording medium being of any known stereophonic type, particularly with at least two tracks, the transmission assembly comprising at least two members such as earphones, loudspeakers or speaker boxes, characterised in that sounds are picked up simultaneously by the two to microphones, known as "right" and "left" respectively and that these two microphones are displaced together with respect to said sound source, particularly by causing the distance and/or height of each microphone to vary differentially with respect to that source, i.e. that one of them is brought doser to the sound source when the other is moved away and vice versa, equally well by either of the two faces of the virtual plane that extends from one to the other, it being possible therefore for the right microphone to become the left microphone and vice versa, it being possible also for the two microphones to be moved simultaneously closer to and further away from said sound source.

The invention also has as its subject-matter a device comprising a sound pick-up assembly, a recording medium and a transmission assembly, the sound pick-up assembly being composed of at least two microphones, opposite each other and held rigidly at a distance from each other that is close to that of the ears of an ordinary human being, and by a sound insulation screen inserted between them, the recording medium being of any known stereophonic type, particularly with at least two tracks, the transmission assembly comprising at least two members such as earphones, loudspeakers or speaker boxes, characterised in that the sound pick-up assembly has no fixing or immobilisation unit, so that it can be displaced and/or oriented at any time, either manually or by kinematic means making it possible to present the microphones to the sound source, equally well by either of the faces of the virtual plane that extends from one to the other and in any intermediate orientation between these two extreme situations.

It will be easier to understand the invention and other additional characteristics from the following detailed description given by reference to the attached drawing. Naturally, the description and the drawing are given only by way of example for information and are not exhaustive.

FIG. 1 is a diagrammatic view illustrating the method and the device in accordance with the invention, in a very simple embodiment.

FIG. 2 is a diagrammatic view illustrating one of the numerous possible phases of the method, according to the same embodiment of the device as in FIG. 1.

FIG. 3 is a diagrammatic view of a more elaborate embodiment of the device according to the invention.

FIGS. 4 to 6 are diagrammatic views illustrating the handling of a device according to the invention, for the variable recording of a fixed sound source.

FIGS. 7 to 9 are diagrammatic views similar to FIGS. 4 to 6, illustrating another way of handling the same device according to the method of the invention, for the recording of the same fixed sound source.

FIGS. 10 to 12 are diagrammatic views illustrating, for an immobile listener, the variable sound impressions he perceives according to the positions of the device in FIGS. 4 to 6.

FIGS. 13 to 15 are diagrammatic views illustrating, for an immobile listener, the variable sound impressions he perceives according to the positions of the device in FIGS. 7 to 9.

Figure 16:
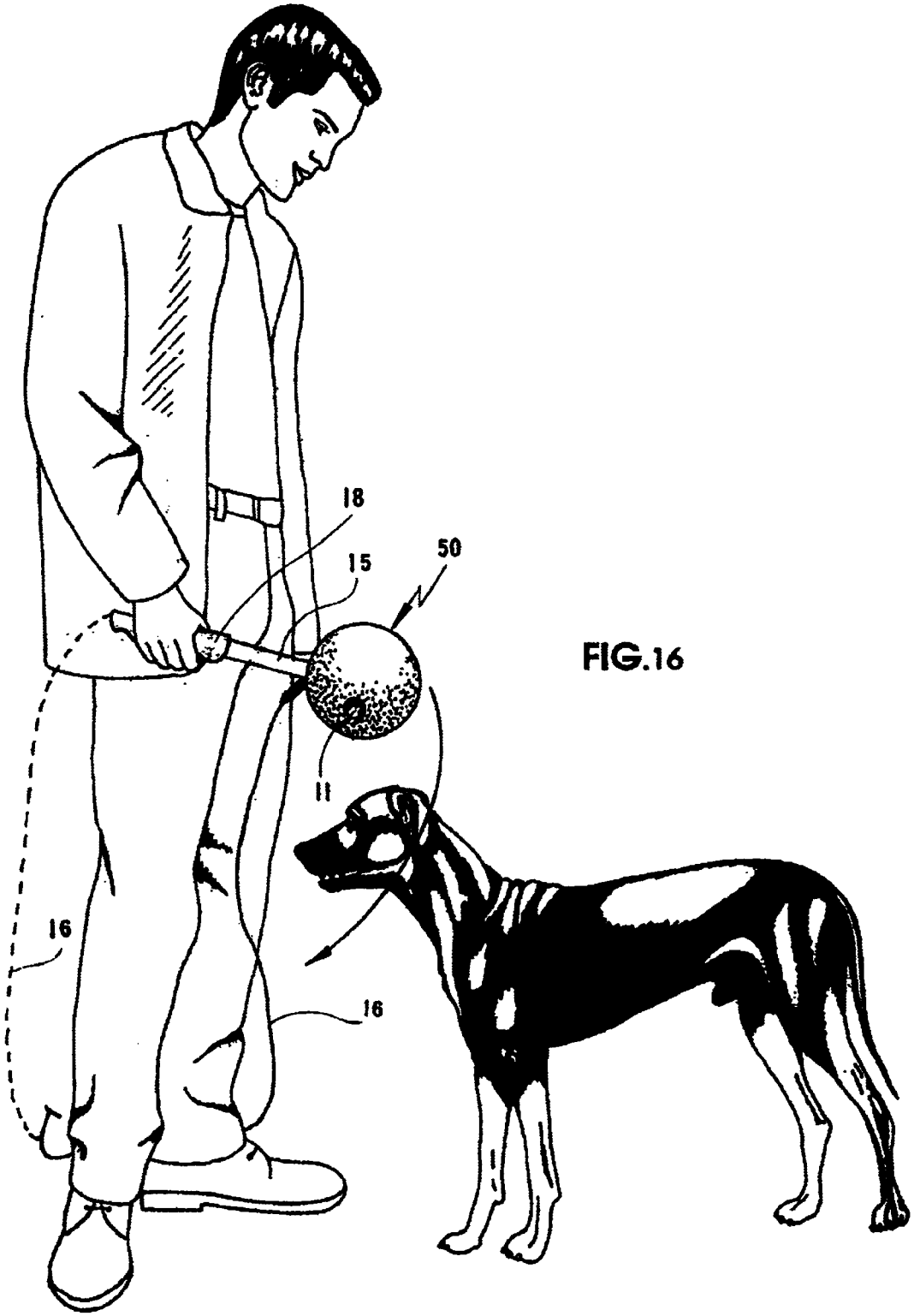
FIG. 16 is a diagrammatic view illustrating a live sound pick-up in accordance with the invention.

Stereophony can relate only to a plurality of sound sources or a large distribution in space. The recording of a symphony orchestra on two tracks and the playback of the recordings on the two tracks by two speaker boxes or two earphones would not really be of interest per se if this stereophony did not constitute a powerful stimulus to the human brain, which artificially reconstitutes for the listener, by unconscious analogy with stored memories, the atmosphere of a concert hall to which he attributes depth and breadth. Otherwise, the listener would be content to hear the violins to the left and the double basses to the right, the other instruments being distributed partly to left and right, with no relief.

This defect is inherent in stereophony and becomes particularly apparent when transmission takes place in an auditorium, particularly a cinema hall, when speaker boxes are placed not only at the front, on the screen side, but also at the back of the hall.

Indeed, the aim sought is to give the best possible sensation of sound space to the spectators, by distributing the sound in such a way that the perception of sound for a movement suggested by an image is as realistic as possible.

This means that if the object represented on the screen is an aeroplane that approaches from the front and flies over the movie camera, the reproduction of the corresponding sound by one or more speaker boxes located near the screen will not allow spectators to perceive a realistic sensation of the aeroplane flying over them, in the cinema hall.

Speaker boxes are placed at the sides of the hall, from the front to the back, and the recorded sounds reproducing the roaring of the engines passes from front to back in such a rapid sequence that the spectators have the impression that the sounds are moving continuously. In reality, the sounds jump abruptly from the front speaker boxes to the rear boxes, known as "surround", and if the displacement of the sounds ought to be slow, the least attentive spectator would immediately be shocked by a sensation of a "sound hole" resulting from the very limitations of stereophony when sounds pass from one speaker box to another, this being even more noticeable when the speaker boxes are far away from each other.

The same obviously applies when reproducing the sounds of an object being displaced from left to right or from right to left when there are only two speaker boxes. In stereophony, apart from the artificial and limited use of "panning" (simultaneous adjustment of sound levels sent to the two speaker boxes, one being reduced, and the other increased) in the plane of the speaker boxes, it is indeed impossible to create a displacement effect that is properly "visual", i.e. fluid and continuous. This limits the possibility of recording since one then has to be content to reproduce sounds which are naturally located either on the right or the left, respectively.

When a complex ensemble is recorded, which is the case for a symphony orchestra, the microphones are placed once and for all at precise locations and the relative positioning of the speaker boxes that reproduce the sounds recorded on a medium, and that of the listener, has to be established fairly strictly, this positioning corresponding to the three vertices of a triangle, the optimum effect being obtained when the sound waves from the two speaker boxes intersect in the space surrounding the listener's head.

Furthermore, since sounds are always picked up from fixed microphones placed at locations described as "strategic", the listener does not really have the notion of three-dimensional space but of relief, thanks again to the stimulus of the brain, which imagines the place where the sound was picked up.

Indeed, the fixedness of the microphones, the fixedness of the sound sources and the fixedness of the speaker boxes have the effect of fixing all the sounds within an illusory volume since no difference in sounds is perceived with respect to level.

In stereophony, there is no up or down.

As concerns the cinema, it is known that it is quite frequently impossible to register correctly the dialogues of actors located in particularly noisy places: public place with noises of voices, station with noises of trains and loudspeaker announcements, seaside with wave noises, etc.

Post-synchronisation is then carried out, which consists in re-recording in a studio, in the greatest silence, the same actors playing the same dialogue and observing the film projected soundlessly. In this way the finished film comprises an "image track" filmed direct and a "sound track" formed by the superimposing of the original sounds, of which the mediocrity or even absence is compensated by the studio re-recording.

Unfortunately this method is far from perfect because it totally lacks realism since, in reality, the words spoken in a situation would have had a completely different tone and the human physiology is such that these words would have been understood perfectly despite the background noise, because of the selectivity of the human ear. Spectators are content with current sound recording because they have nothing to compare it with, just as listeners appreciated musical recordings on 78 rpm discs, then 33 rpm ones, but now that we have laser discs it is very difficult to go back to old listening conditions.

The invention offers a new recording method, which makes it possible to create really not a simple finite volume but a three-dimensional sound space that is immediately perceptible to a listener, transversely (from −□ to the left to +□ to the right, passing through the immediate proximity), from the point of view of height (upwards and downwards), longitudinally (from −□ behind the listener to +□ in front of the listener, passing through the immediate proximity).

Furthermore, the invention makes it possible to produce particularly lifelike recordings by producing listening conditions that are extremely close to what they must have been on the spot, at the time of recording.

The sound pick-up device is specific and the method is quite different from current methods since it is even possible to show that it is contrary to all known recommended practice.

The reproduction of recorded sounds takes place by means of earphones or speaker boxes according to listening conditions; in private, in public, from a disc, from a film soundtrack, etc.

With the invention, it is possible to create hitherto unknown effects, particularly by giving a sound effect of mobility from the recording of a single sound source. Referring to FIGS. 1 and 2, we can see a device according to the invention in its simplest form. It comprises an autonomous sound pick-up assembly 10 formed of two microphones 11 and 12 joined rigidly by a rod 13, the length of which is close to the distance in a straight line that separates the two ears of an ordinary human being and that carries a plane longitudinal screen 14 having the best possible sound insulation qualities in order to distinguish the two microphones 11 and 12 as much as possible. Furthermore, the assembly 10 is integral with an operating handle 15 since it does not have any fixing or immobilisation member. An electric cable 16 containing leads specific to each of the two microphones 11 and 12 joins the assembly 10 and a piece of recording apparatus 20 of any known type capable of differentiating the signals coming from the microphones 11 and 12. Here, a diagrammatic representation is given of an assembly making it possible to use a cassette 21 symbolising any recording medium.

The cassette 21 is then used as normal by reading it in a piece of sound play-back apparatus 30 to which headphones 40 provided with two earphones 41 and 42 is connected by a cable of any known type 43 containing leads specific to each of the earphones 41 and 42.

In relation to a single sound source A, illustrated here by a trumpet, the assembly 1 is handled by a user starting from the position illustrated in the top right-hand portion of FIG. 1.

Without substantially changing the position in space of the assembly 1, the user can cause the assembly 10 to pivot, faster or slower, more or less along the axis of the handle 15, from the orientation drawn in a solid line to the orientation drawn in a dashed line, as shown by the double arrow F1.

Because of this, the microphone 11 is nearer the source A than the microphone 12 in one orientation and farther away in the opposite orientation. If the user moves the assembly 10 in the direction of the arrow F2, substantially over a semicircular path, but without modifying its orientation, the microphone 11 will remain the farthest away of the two microphones from the source A but the sound picked up by the microphone 12 will first become amplified and will then reduce. When the assembly 10 is directly in front of the source A, i.e. when the plane screen 14 almost completely masks the microphone 11, the sound reaching the microphone 12 will be clearly predominant and a small residual portion of the original sound will be picked up by the microphone 11.

FIG. 2 shows the possible movement of the assembly 10 above the source A, from a position of proximity at bottom left to a remote position at top right in this figure without changing orientation, which corresponds to a constant relative position of the two microphones 11 and 12 with respect to the source A, in contrast with the example in FIG. 1.

These modifications in sound pick-up are possible not only because the assembly 10 comprises two microphones 11 and 12 but also because of the plane screen 14 which, for the user, is a simple and effective materialisation of orientation.

On the other hand, since the two microphones 11 and 12 are identical, it is preferable to give the user a means of identifying the microphones, for example by putting on these, or in their immediate vicinity, a "right"–"left" marker since, as we can understand, each microphone corresponds to one of the earphones 41 and 42. The microphone 11 considered to be the right-hand microphone corresponds to the earphone 41, and the microphone 12 considered to be the left-hand one corresponds to the earphone 42.

An equivalent would consist in indicating, for example by means of an arrow (not shown) the front of the plane screen 14 in relation to its rear.

FIG. 3 illustrates a more elaborate embodiment of the device which, here, in addition to the plane longitudinal screen 14, comprises a plane transverse screen 17 that extends from one microphone to the other, in order to determine a sound space in front of the microphones 11 and 12 and a sound space behind said microphones 11 and 12 since, reinforced by the longitudinal screen 14, they differentiate only between the right and left-hand spaces to the side.

This device, provided with the same handle 15 as in FIGS. 1 and 2, can be handled as mentioned above but, here, the movements of the assembly 10 make it possible to make a clear distinction between the pre-eminence of sounds at the front and sounds from behind, and vice versa.

Here, it is crucial for the user to know constantly, without any ambiguity, how the assembly 10 is oriented in order to differentiate each of the two front and back faces of the transverse plane screen 17 since the sounds recorded when pivoting the assembly 10 lead to an effect with major consequences on the listening sensation when playing back the recorded sounds. It will be understood that, in this case, the listener will hear sounds in front of him or behind him depending on the face of the transverse screen 17 that is directly exposed to the sound source and the one that is isolated from it by the screen 17.

It will be observed in FIG. 3 that the two plane screens 14 and 17, which are perpendicular and of equal length and height, can be inscribed within a virtual sphere B close to the standard volume of a human head.

Now, sound pick-up devices are known, constituted by pairs of microphones placed opposite each other on spheres and provided with fixing members, with a view to what is known as their "strategic" positioning.

The invention makes it possible to produce the screens, longitudinal and transverse respectively, by merging them into a sphere made of sound insulating material since the lateral nature is marked by the insulating mass of the sphere considered transversely and the front-back differentiation comes from the insulating mass of the sphere considered longitudinally.

It is this embodiment that is now described and illustrated in FIGS. 4 to 9 and 16.

This spherical assembly 50 must be lacking in any fixing member, contrary to known devices, and the mobility to which it has to be subject makes it essential for the user to have a front-back and/or right-left identification means. Since, furthermore, the assembly 50 has to have an operating handle 15, it is advantageous to give concrete form to the front-back marker (which will automatically lead to the correct right-left positioning of the microphones 11 and 12) by giving the handle 15 an asymmetrical profile constituting a locating means, preventing orientation that is the opposite of the desired orientation.

In FIGS. 1 to 3 and 16, it can be seen that the handle 15 is provided with a sleeve 18, which is smooth on the back and has indentations at the front.

In this way the user instinctively understands that the front indentations determine the position of his fingers closed over the sleeve 18 (FIG. 16).

FIGS. 4 to 6 illustrate a simple pivoting movement of the assembly 50 with respect to the sound source A.

In FIG. 4 the microphone 12 is nearest to the source A and therefore receives a maximum sound flow, while the microphone 11 is exactly opposite the source A and receives only residual sounds, particularly those arising from echoes.

In FIG. 5, the microphones 11 and 12 are equidistant from the source A and receive the same flow.

In FIG. 6 the microphone 11 is closest to the source A and therefore receives a maximum sound flow, whereas the microphone 12 is exactly opposite the source A and receives only residual sounds, particularly those arising from echoes. This orientation is therefore exactly symmetrical with that in FIG. 4.

It is possible to change from one of the orientations in FIGS. 4 and 6 to the other relatively quickly but, in any case, each microphone 11-12 picks up sounds that increase for one and decrease for the other. It will be observed that the direction of pivoting given by the arrow F3 implies that the handle 15 moves from the extreme left to the extreme right by the bottom of the figures, i.e. behind the transverse plane 14, which means that the sounds reach the microphones 11 and 12 continuously from the front of the transverse plane 14.

FIGS. 7 to 9 are similar to FIGS. 4 to 6, but while the assembly 10 does indeed still pivot in the direction of the arrows F3, it has a starting position in which the microphone closest to the source A is the microphone 11. Consequently, the sounds coming from the source A reach the microphones 11 and 12 constantly from behind the transverse plane 14.

Referring now to the FIGS. 10 to 15, it can be seen how the sounds picked up according to the diagrams in FIGS. 4 to 9 are perceived by a listener, only the head of whom is illustrated, seen from above, wearing the headphones 40 oriented in such a way that the earphone 41 covers his right ear and the earphone 42 his left ear.

The arrows symbolise the sounds according to the direction perceived by the listener, but it is obviously impossible, on the plane of a sheet of paper, to show the three dimensions of space.

In FIG. 10 the listener hears, almost exclusively through the left ear wearing the earphone 42, the sounds picked up by the microphone 12 in FIG. 4.

In FIG. 11 the listener hears sounds distributed from right to left, according to a panoramic front distribution, corresponding to the symmetrical orientation of the microphones 11 and 12 in FIG. 5, the virtual transverse plane of the assembly 10 having its front face arranged towards the source A.

In FIG. 12 the listener hears, almost exclusively through the right ear wearing the earphone 41, the sounds picked up by the microphone 11 in FIG. 6.

Assuming that the assembly 10 has been displaced in the plane of the drawing, the listener perceives sounds that are displaced from left to right, substantially at a constant height and with an unchanged sensation of proximity.

But if the movements of the assembly 10 when sounds are picked up take the assembly 10 upwards or downwards, in addition to pivoting, the listener will perceive the change in level perfectly.

Furthermore, if the assembly 10 undergoes movements of getting closer to and further away from the source A, the listener will have the very clear impression of the source being displaced with respect to him.

For example, an experiment has been able to show that a listener perceives the voice of a person approaching him, as if the person were approaching himself. If the picking up of sound ends with the microphone being placed as close as possible to the lips of the person, while asking that person to lower his voice to the softest murmur, the listener gets the impression that the person is really close to him and is whispering into his ear.

All this is outside the realm of stereophony.

In FIGS. 13 to 15 the listener starts by hearing sounds to the right, then he hears the sounds moving towards the left until they are audible, in practice, only on the left, but here, moving behind his head since the pick-up of sounds according to FIGS. 7 to 9 presents to the source A the rear face of the transverse virtual plane.

The experiment illustrated above is even more impressive here since, because the voice approaches behind the listener's back, some sensitive people turn round abruptly, really believing there is a person present.

FIG. 16 illustrates an example of sound pick-up by means of an assembly 50, which is manipulated around the head of a panting dog, and the listener then hears this sound pick-up, having the impression that the dog is moving around him and, depending on the movements of the assembly 50, getting further away and closer When the sound source is a musical instrument it is possible to give the recording quite novel effects, particularly by causing the assembly 50 to move around a piano, which produces a recording where reproduction has a variable intensity and gives the impression of movements of the piano that are inconceivable because they are unreal, for example the piano flying over the listener.

It is also possible to use as a sound source a recording transmitted by a loudspeaker, a soundtrack, for example, that can be mixed with other particular recordings.

A magnetic tape transmitted by a speaker box can be re-recorded then repositioned in a different, artificial, sound space.

After having recorded instruments one by one according to the method of the invention, mixing is carried out, making it possible to create a true "sculpture" of the sound track since relief effects are obtained, arising from moving away, moving towards and pivoting with respect to the instrument which itself remains fixed.

The displacement of the whole assembly and the microphones it carries makes it possible to vary differentially the distance, in all directions in space, of each microphone with respect to the source and to present to that source one of the two faces of the transverse virtual plane.

Of course, the method of the invention can now be used with several sound sources and not just one, and when a symphony orchestra or a large jazz band is recorded, for example, it is possible to make effects equivalent to those of optical zoom, namely that without in any way modifying the musical performance, priority can be given to an individual instrument or one part of the orchestra over another. Having made particular recordings, they are combined freely, as the user wishes, on two recording tracks, in order to group together the right and left-hand recordings that will be assigned, on listening, either to the right-hand earphone or the left-hand earphone.

Figure 17:
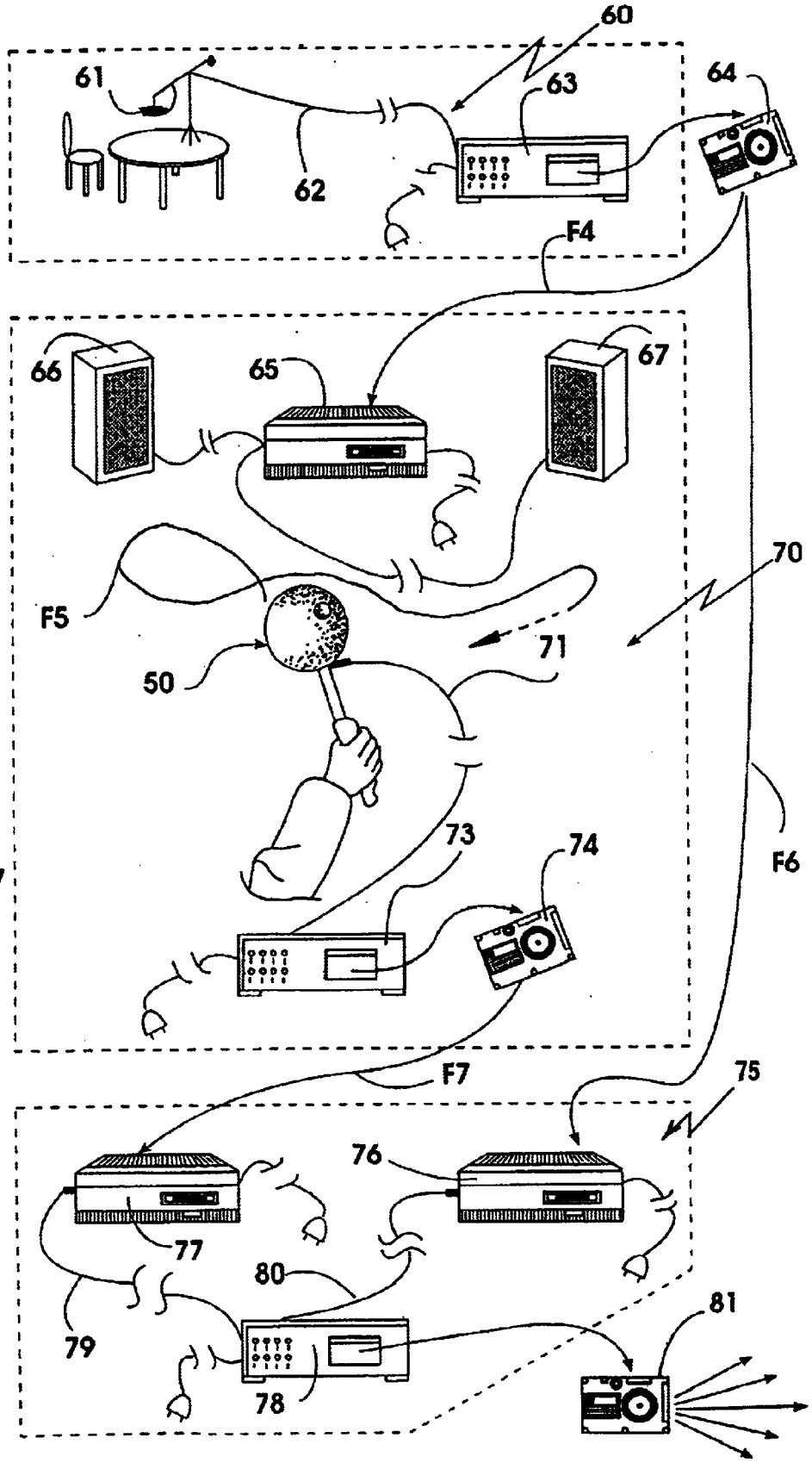
FIG. 17 is a diagrammatic view illustrating a characteristic of the invention that comprises recording of sounds emitted by apparatus for radiating acoustic energy into the surrounding space, namely, here, speaker boxes.

Referring now to FIG. 17, we see a particular application of the invention, which is illustrated by an example providing, first of all, sound pick-up in a studio 60, comprising a microphone 61 of any known type, which has been chosen here as being of monophonic type. The microphone 61 is connected by a conductor cable 62 to a piece of recording apparatus 63 which, here, is symbolised by a cassette recorder.

The recorded cassette 64 therefore contains a recording known as "initial", which can be described as "flat" since the sound pick-up in the studio 60 takes place in silence. The recording therefore concerns only words spoken in front of the microphone 61 or music isolated from any ambience.

The cassette 64 is placed in a piece of reading apparatus 65, as shown by the arrow F4, connected to two speaker boxes 66 and 67, the whole being located in a place 70 other than the recording studio 60.

In accordance with the invention, the sounds transmitted by the speaker boxes 66 and 67 are picked up and then recorded, contrary to all universally accepted principles, which are based on the premise that the quality of collected sound is degraded by the characteristics of the reader, its vibrations and its imperfections, not to mention the defects of the recording medium or the background noise existing in the place where the recording is made.

But here the assembly 50 described above is used in the place 70, which is natural or artificial, possibly with sound effects, so that this sound pick-up allows the operator not only to move the assembly 50, as symbolised by a long winding arrow F5, but also to add to the sounds of the initial recording those that exist in the sound pick-up location, i.e. not only natural ambient noise or added noise, but also sounds arising from the very conditions of the location 70, particularly sounds picked up after reverberation from obstacles nearby: walls, ceiling, miscellaneous objects, etc.

If, for example an initial recording is made in the studio 60 of a symphony orchestra, this produces sounds that are as pure as possible but somewhat disembodied, cold and flat, if we think of the listening conditions of a real concert hall, live.

Based on this initial recording, the invention makes it possible to obtain a stereophonic recording known as "specific" by means of an assembly 50, in a large hall, such as a concert hall or auditorium, with the result that the specific recording adds to the orchestra the ambience and reverberations of the hall, the whole being enriched by the conditions of sound pick-up specific to the invention.

The assembly 50 is connected by a lead 71 to a piece of stereophonic recording apparatus 73, thereby producing a specific recording on a medium that has been shown diagrammatically here by a cassette 74.

Next, in premises 75, which can be a studio, the initial recording medium 64 is placed in a reader 76 (arrow F6) and the specific recording medium 74 in a reader 77 (arrow F7), both connected to a piece of recording apparatus 78 by leads 79 and 80.

The two readers 76 and 77 are synchronised so as to obtain superimposition of the initial recording and the specific recording, this combination giving rise to what is known as the "definitive" recording, placed on a recording medium symbolised by a cassette 81.

This recording device can obviously be optimised by specific means such as multitrack recording apparatus, software using what is known as "DtD" technology (abbreviation of "Direct to Disk"), etc.

After specific mastering treatment, this recording medium constitutes the master from which as many copies as necessary can be made, these copies being intended for commercial distribution.

Naturally, the cassettes shown In FIG. 17 can in reality be recording media of all sorts, particular soundtracks of cinema films or video tapes.

These recording media are intended for reading apparatus, itself of any known type, associated with transducers such as earphones or speaker boxes.

When auditoriums are concerned the speaker boxes, arranged as explained above: near the screen, at the sides and the back of the hall constitute a transmission assembly with hitherto unknown performance, particularly owing to the fact that the picking up of sound according to the invention makes it possible to restore on hearing a "sound glide" totally eliminating the effect of the sound hole, so that it is now possible to make the sounds circulate from speaker box to speaker box without any discontinuity and consequently the use of multiple speaker boxes is no longer reserved for the reproduction of rapid, flashing sound, but also slower sounds, such as the steps of a person approaching or moving away.

As for musical recordings, it has been understood that it was now possible to offer studio recordings of perfect quality, giving the impression that they were made in a huge concert hall.

In short, the listener at home hears an orchestra as if he were alone in the concert hall, with a complete sensation of space and realism, but without the disadvantages of a large audience: repeated coughing, untimely applause, etc.

At the time of the definitive recording, the sound levels of the readers 76 and 77 are adjusted so that the sound level of the initial recording is at a level considered to be the reference level, while the sound level of the specific recording can evolve on either side of the reference level. To put things in context, if we consider the reference level to be zero, the sound level of the specific recording ranges from −5 to +5, depending on the specific spatial effect that is required.

What is claimed is:

1. A method for picking up sounds coming from at least one sound source for recording and playing back said sounds using a sound pick-up assembly, a recording medium and a transmission assembly, the sound pick-up assembly having at least two microphones, the relative positions of which are constant, the recording medium being stereophonic having at least two tracks, the transmission assembly comprising at least two audio diffusion members, the method comprising:

picking up sounds from the at least one sound source simultaneously with the at least two microphones;

displacing the at least two microphones together with respect to the at least one sound source concurrently with the picking up sounds;

one of the at least one sound sources being a pre-existing recording, the pre-existing recording being an initial recording;

transmitting sounds from the initial recording using loudspeakers located in a place having acoustic and sound characteristics replicating optimal acoustic and sound characteristics;

making a specific recording of the sounds from the initial recording in the place, said specific recording being influenced by the acoustic and sound characteristics;

subsequently playing back the sounds from the initial recording and the specific recording; and making a final recording by superimposing the initial recording and specific recording, for later transmission of the final recording.

2. The method according to claim 1, further comprising setting the playing back of the initial recording at a constant sound level, the constant sound level being a reference level, and a second sound level of the play back of the specific recording is varied within a range extending continuously from a minimum value to a maximum value and encompassing the reference level.

3. The method according to claim 1, further comprising recording of a fewer number of sound sources than the total number of sound sources to make a particular recording, making a plurality of particular recordings and storing the plurality of particular recordings on the at least two tracks.

4. A device comprising:

a sound pick-up assembly for receiving at least one sound source, the sound pick-up assembly having two microphones oriented in opposite directions and held rigidly at a distance from each other approximating a distance between the ears of a person, the sound pick-up assembly having means for displacing and orienting the sound pick-up assembly at any time while picking-up sounds from the at least one sound source in order to present the two microphones to the at least one sound source in any orientation ranging 360° from one face of a virtual plane parallel to an axis joining the two microphones pointed directly at the at least one sound source;

a recording medium being a stereophonic type and having at least two tracks thereon;

a transmission assembly comprising at least two audio diffusion members; and a marker on the pick-up assembly for differentiating between the faces of the virtual plane, the marker comprising an asymmetric handle integral with the sound pick-up assembly.

5. The device according to claim 4, wherein the sound pick-up assembly has a substantially planar sound insulation screen interposed between the microphones.

6. The device according to claim 4, wherein the sound pick-up assembly further comprises a sound insulation member extending between the microphones for defining a front sonic space and a rear sonic space.

7. The device according to claim 4, further comprising a sound insulation member comprising a substantially spherical volume approximately the same as a head of a human being, and a screen for separating the two microphones on opposite sides of the spherical volume.

8. The device according to claim 4, wherein the at least one sound source comprises an apparatus for radiating acoustical energy into the surrounding space.

9. The device according to claim 4, wherein the recording medium comprises one of a disk, a magnetic tape and a compact disk.

10. The device according to claim 4, wherein the recording medium is one of a sound track of a cinema film and a video medium.

11. The device according to claim 4, wherein the transmission assembly comprises a reader for sound recording media and a pair of apparatus for radiating acoustic energy into a surrounding space, the pair of apparatus spaced from each other and corresponding to right-hand and left-hand channels.

12. The device according to claim 4, wherein the transmission assembly is located in a premises having an image presentation screen, and the transmission assembly further comprises a reader for audiovisual recording media and a plurality of apparatus for radiating acoustic energy into a surrounding space for reproducing right-hand and left-hand channels.

13. The device according to claim 4, wherein the transmission assembly is located in an auditorium having an image presentation screen, the transmission assembly comprising a reader for audiovisual recording of media, and a plurality of apparatus for radiating acoustic energy into a surrounding space, the plurality of apparatus arranged spaced apart in a front and a rear of the auditorium.

14. The device according to claim 4, wherein the transmission assembly comprises a reader for sound recording media and headphones having two earphones.

15. A method for processing pre-recorded initial sound signals emanating from at least one sound source using a sound pick-up and transmission assembly, the method comprising:

providing the sound pick-up and transmission assembly with left and right microphones;

arranging the sound pick-up and transmission assembly in front of the sound source;

simultaneously picking-up the pre-recorded initial sound signals from the at least one sound source using the left and right microphones;

generating transmitted sound signals corresponding to the picked-up initial sound signals;

superimposing the initial sound signals on the transmitted sound signals; and diffusing the superimposed signals to produce a specific recording.

16. The method according to claim 15, further comprising producing multiple specific recordings corresponding to the sound source and storing the specific recordings on at least two tracks of a recording medium.

17. A method for picking up sounds coming from at least one sound source for recording and playing back said sounds using a sound pick-up assembly, a recording medium and a transmission assembly, the sound pick-up assembly having at least two microphones, the relative positions of which are constant, the recording medium being stereophonic having at least two tracks, the transmission assembly comprising at least two audio diffusion members, the method comprising:

picking up sounds from the at least one sound source simultaneously with the at least two microphones, wherein one of the at least one sound sources is a pre-existing recording, the pre-existing recording being an initial recording; and displacing the at least two microphones together with respect to the at least one sound source;

transmitting sounds from the initial recording using loudspeakers located in a place having acoustic and sound characteristics at least approximately replicating acoustic and sound characteristics existing at the time the initial recording was made;

making a specific recording of the sounds from the initial recording in the place, said specific recording being influenced by the acoustic and sound characteristics;

subsequently playing back the sounds from the initial recording and the specific recording; and making a final recording by superimposing the initial recording and specific recording, for later transmission of the final recording.

* * * * *